US006286872B2

(12) United States Patent
Barre

(10) Patent No.: US 6,286,872 B2
(45) **Date of Patent: *Sep. 11, 2001**

(54) LABEL, ESPECIALLY FOR A PACKAGE FOR A COSMETIC PRODUCT

(75) Inventor: Patrice Barre, Antony (FR)

(73) Assignee: L'Oreal, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/227,351

(22) Filed: Jan. 8, 1999

(30) Foreign Application Priority Data

Jan. 21, 1998 (FR) ..... 98 00613

(51) Int. Cl.[7] ..... B42D 15/00
(52) U.S. Cl. ..... 283/81; 283/109; 283/101
(58) Field of Search ..... 428/41.7; 283/81, 283/101, 105, 107, 109, 64, 100; 40/310

(56) References Cited

U.S. PATENT DOCUMENTS 3,790,439 * 2/1974 La Perre et al. ..... 283/64 X
4,519,155 * 5/1985 Gallagher et al. ..... 283/109
4,749,084 * 6/1988 Pereyrn ..... 283/109 X
5,851,617 * 12/1998 Keiser ..... 283/100 X
5,904,973 * 5/1999 Coward et al. ..... 283/81 X
5,972,478 * 10/1999 Farrow ..... 283/101 X

FOREIGN PATENT DOCUMENTS 0 763 809 3/1997 (EP) .
2-264 338 10/1975 (FR) .
40 26 208 2/1992 (FR) .
2 725 065 3/1996 (FR) .
6-341068 12/1994 (JP) .
7-040514 2/1995 (JP) .
7-44106 2/1995 (JP) .
7-157729 6/1995 (JP) .
8-50452 2/1996 (JP) .
9-254335 9/1997 (JP) .

* cited by examiner

*Primary Examiner*—Willmon Fridie, Jr.
(74) *Attorney, Agent, or Firm*—Oblon, Spivak, McClelland, Maier & Neustadt, P.C.

(57) ABSTRACT

A label (1), intended to be applied especially to a package for a cosmetic product, is formed of a substrate (2) one side (6) of which is printed, and a film (8) of nonwoven material placed on the printed side (6) of the substrate. The film (8) is transparent so that the printing on the substrate (2) can be seen through the film (8).

15 Claims, 1 Drawing Sheet

LABEL, ESPECIALLY FOR A PACKAGE FOR A COSMETIC PRODUCT

BACKGROUND OF THE INVENTION

1. Field of the Invention

The present invention relates to a label intended to be applied especially to a package for a cosmetic product. The label is most particularly suitable for bottles, such as those used for packaging shampoos, lotions, beauty creams or gels, especially washing gels.

2. Description of the Related Art

Conventionally, labels used in the field of cosmetics are formed from self-adhesive sheets made of materials such as high-density polyethylenes, polypropylenes, polyvinyl chlorides, polyethylene terephthalates and paper. The opposite side of the sheet from the adhesive layer is printed, especially using screen printing, letterpress printing, flexography or offset printing. Optionally, a varnish is deposited on the printed side. Such labels are characterized by a relatively smooth "feel".

In this field of the packaging of cosmetic products, new concepts are always being sought both in terms of the visual appearance of the package, and of its functional characteristics, and in terms of its sensory aspect, particularly its feel. Thus, a demand has arisen for replacing the traditional "feel" of thermoplastic-type bottles with warmer, softer types of feel, such as those provided by fabrics.

Printing on materials such as nonwovens turns out to cause problems, especially in terms of the resolution of the printing. These problems are especially due to the coarse characteristics of such materials compared with what may be obtained with woven fabrics. Thus, Japanese Application JP-A-7040514 suggests covering the nonwoven material with a printing layer based on a polyester resin. Apart from the drawback due to the cost of such an operation, this approach has the drawback of significantly affecting the feel of the nonwoven material which, because of the presence of the polyester resin, is similar to the conventional types of feel of thermoplastics.

SUMMARY OF THE INVENTION

One of the objects of the invention is therefore to produce a label which is especially suitable for the decoration and marking of packaging for cosmetic products and which provides a feel and an appearance that differ from those of conventional labels.

Another object of the invention is to provide a low-cost label allowing good printing resolution and having a feel of the fabric type.

Yet another object of the invention is to produce a package provided with a label according to the invention.

According to a first aspect of the invention, these and other objects are achieved by a label, intended to be applied especially to a package for a cosmetic product, comprising a printed substrate and a film of nonwoven material placed on the printed substrate, the film being transparent so that the printing on the substrate can be seen through the film.

The label has the feel of the fabric and retains the excellent printability characteristics, especially in terms of print resolution, of conventional labels. Apart from the sensation that it gives, this feel, above all in the cosmetics field, is most particularly advantageous in that it improves the graspability of the container provided with such a label, particularly when such a container is intended to be used in the bathroom environment, especially under the shower.

Advantageously, the opposite side of the substrate from the film of nonwoven material is covered with an adhesive layer to which a peel-off sheet is affixed before being applied to the package, that side of the peel-off sheet in contact with the adhesive layer being covered with a non-stick material, especially silicone. The label may, however, not be of the self-adhesive type. In this case, before affixing the label to the surface intended to receive it, either the label or the surface is coated with an adhesive composition.

Such a sheet may consist of a material chosen especially from among polyethylene terephthalates, polypropylenes and paper.

According to a preferred embodiment, the film of nonwoven material is fastened to the substrate by bonding, by means of an adhesive or a varnish.

The substrate may consist of a material chosen from among high-density polyethylenes, polypropylenes, polyvinyl chlorides, polyethylene terephthalates and paper. Its thickness may be from 20 $\mu$m to 200 $\mu$m, and preferably from 40 $\mu$m to 100 $\mu$m. Such a substrate must not be too thick so that the final label is suitably flexible in order to follow the contour of the surface to which the label is affixed. The substrate is preferably transparent, in which case the printed side of the substrate may either be the side facing the film of nonwoven material or be on the opposite side from the film of nonwoven material.

The nonwoven material may be a nonwoven of thermoplastic fibers, especially polyolefin fibers, such as polypropylene or polyethylene fibers, or polyester fibers. Its color is preferably white, or slightly tinted. The feel obtained varies depending on the nature and the thickness of the nonwoven material. In fact, it is possible to obtain very varied types of appearance and of feel, which may range from silky to rough, passing through a multitude of gradations, depending on the characteristics sought.

Typically, the film of nonwoven material has a thickness of from 20 $\mu$m to 500 $\mu$m, and preferably from 100 $\mu$m to 300 $\mu$m. This thickness must not be too great so that the film is sufficiently transparent for the printed decoration to be visible. However, it must be sufficient to give the desired feel.

Another aspect of the invention provides a container having a label according to the first aspect. Such a container preferably consists of a bottle, such as one used conventionally for packaging shampoos, washing gels, lotions, etc. Again by way of example, such a label may be affixed to a can such as an aerosol-can, or to a tube.

BRIEF DESCRIPTION OF THE DRAWINGS

Apart from the arrangements explained above, the invention consists of a number of other arrangements which will be explained below with regard to non-limiting embodiments described with reference to the appended Figures, among which.

DETAILED DESCRIPTION OF THE PREFERRED EMBODIMENT

Figure 1:
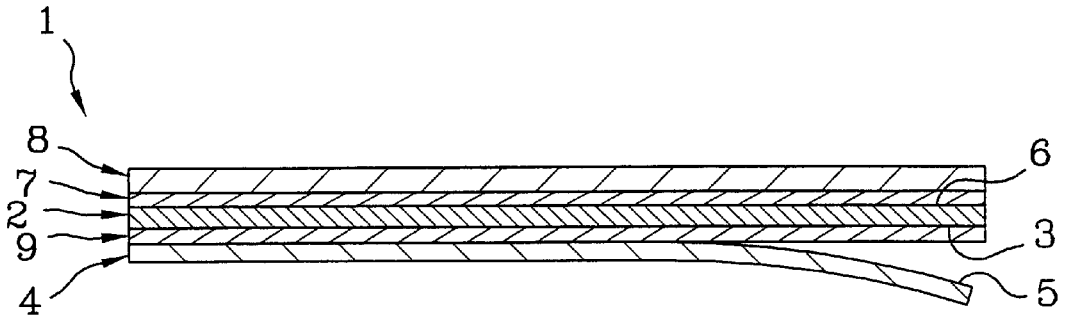
FIG. 1 shows a cross-sectional view of a preferred embodiment of a label according to the invention.

The label 1 shown in FIG. 1 has a printable substrate 2 which may or may not be transparent, and which is made of high-density polyethylene, of polypropylene, of polyvinyl chloride, of paper or of polyethylene terephthalate. Purely by way of example, in the case of a high-density polyethylene substrate, its thickness is about 80 to 100 μm. In the case of a polypropylene, its thickness is about 40 to 60 μm. In the case of paper, its thickness is about 100 μm. Other materials may also be used.

One side 6 of the substrate is printed and bears information relating especially to the identification of the product and to its brand or commercial name, or any other information for purely decorative purposes. The printing is effected by any known technique, especially by screen printing, letterpress printing, flexography or offset printing.

The side 3 of the support 2 opposite the printed side 6 is covered with an adhesive composition 9 on which is removably deposited a peel-off sheet 4 consisting of a material chosen especially from among polyethylene terephthalates, polypropylenes and paper. That side 5 of the peel-off sheet 4 in contact with the adhesive composition 9 is covered with a non-stick layer, especially a silicone layer. The sheet 4 is removed just before applying the label 1 to the package.

Deposited on the printed side 6 of the substrate is an adhesive layer 7, especially an adhesive or a varnish having good adhesive properties.

A film 8 of carded nonwoven material covers the printed side of the substrate 2, to which side the film adheres by means of the adhesive layer 7. Such a film of nonwoven material is formed from a relatively tightly entangled mass of fibers, especially synthetic fibers, which are bonded together in a conventional manner, by hot lamination, by passing them between two rollers one of which is heated and has embossing opposite which the points of bonding will be formed. A surface of the film 8 is thereby embossed by the embossing roller. By way of example, a polyolefin nonwoven material, especially a polypropylene or polyethylene nonwoven material, is used. As a variant, a polyester nonwoven material is used. The thickness of the film 8 may be about 100 μm to 300 μm.

With such an embodiment, because of the contact transparency of the film of nonwoven material, the information printed on the side 6 of the substrate 2 can be seen through the film of nonwoven material.

Figure 2:
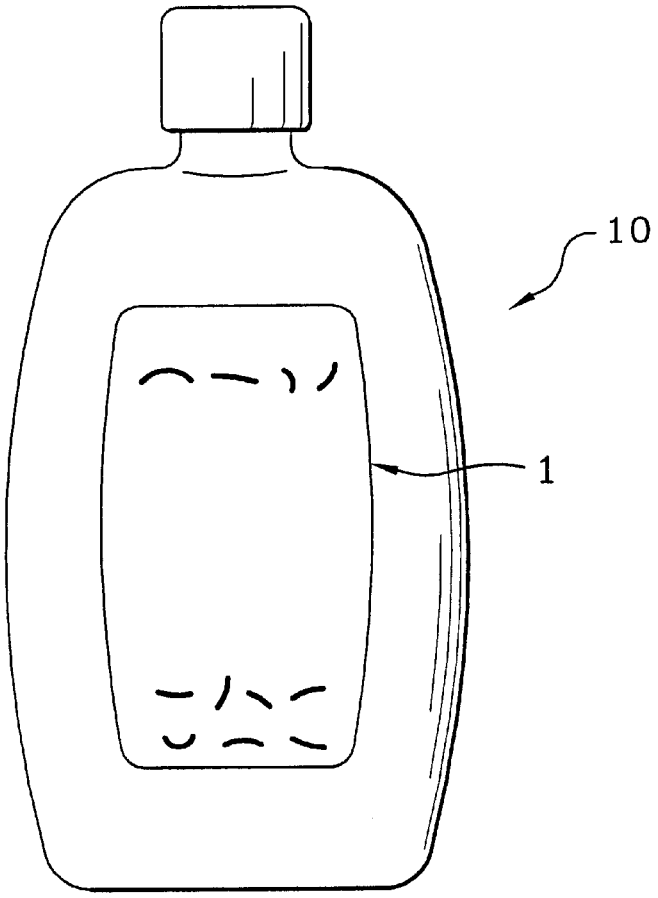
FIG. 2 shows an embodiment of a container according to the invention.

FIG. 2 shows an embodiment of a container 10 covered with a label as described in FIG. 1. Such a container may be in the form of a bottle of ovoid cross section, whose body has two main faces, the label I being affixed to one of these two main faces. Likewise, such a container could consist of a tube or a can, for example an aerosol or spray-can.

In the above detailed description, reference was made to preferred embodiments of the invention. It is obvious that variants may be made thereto without departing from the scope of the invention as claimed hereinafter.

What is claimed is:

1. A label to be applied to a package for a cosmetic product, comprising:

a printed substrate; and a film of nonwoven fibrous material placed on the printed substrate, said film having an embossed surface and being sufficiently transparent that the printing on the substrate can be seen through said film.

2. The label according to claim 1, wherein a side of the substrate opposite the film of nonwoven material is covered with an adhesive layer to which a peel-off sheet is affixed, and wherein a side of the peel-off sheet in contact with the adhesive layer is covered with a non-stick material.

3. The label according to claim 2, wherein the peel-off sheet includes a material chosen from among polyethylene terephthalates, polypropylenes and paper.

4. The label according to claim 1, wherein said film of nonwoven material is fastened to the substrate by bonding with an adhesive or a varnish.

5. The label according to claim 1, wherein the substrate comprises a material chosen from among high-density polyethylenes, polypropylenes, polyvinyl chlorides, polyethylene terephthalates and paper.

6. The label according to claim 1, wherein the substrate has a thickness of from 20 μm to 200 μm.

7. The label according to claim 1, wherein the nonwoven material is a nonwoven material of thermoplastic fibers.

8. The label according to claim 4, wherein said bonding comprises one of an adhesive and a varnish.

9. The label according to claim 1, wherein the substrate has a thickness of from 40 μm to 100 μm.

10. The label according to claim 1, wherein the nonwoven material is a nonwoven material of polyolefin fibers.

11. The label according to claim 10, wherein the polyolefin fibers comprise one of polypropylene, fibers, polyethylene fibers and polyester fibers.

12. A container having a label comprising:

a printed transparent substrate; and a film of nonwoven fibrous material placed on the printed substrate, said film having an embossed surface and being sufficiently transparent that the printing on the substrate can be seen through said film.

13. The container according to claim 12, wherein the container comprises one of a bottle, a tube and a can.

14. A container filled with a wash gel and having a label comprising:

a printed transparent substrate; and a film of nonwoven fibrous material placed on the printed substrate, said film having an embossed surface and being sufficiently transparent that the printing on the substrate can be seen through said film.

15. A container filled with a shampoo and having a label comprising:

a printed transparent substrate; and a film of nonwoven fibrous material placed on the printed substrate, said film having an embossed surface and being sufficiently transparent that the printing on the substrate can be seen through said film.

* * * * *